US007360520B2

(12) United States Patent
Tullis et al.

(10) Patent No.: US 7,360,520 B2
(45) Date of Patent: Apr. 22, 2008

(54) DAMPED WINDAGE TRAY AND METHOD OF MAKING SAME

(75) Inventors: Bryan Tullis, Chicago, IL (US); Karl D. Karlson, West Bloomfield, MI (US)

(73) Assignee: Material Sciences Corporation, Elk Grove Village, IL (US)

( * ) Notice: Subject to any disclaimer, the term of this patent is extended or adjusted under 35 U.S.C. 154(b) by 0 days.

(21) Appl. No.: 11/389,910

(22) Filed: Mar. 27, 2006

(65) Prior Publication Data

US 2007/0221159 A1 Sep. 27, 2007

(51) Int. Cl.
*F02F 7/00* (2006.01)
*F01M 1/02* (2006.01)

(52) U.S. Cl. ..... 123/195 R; 123/196 R; 428/461

(58) Field of Classification Search ..... 123/196 R, 123/195 R; 29/888.01; 296/193.07; 428/422, 428/457, 461
See application file for complete search history.

(56) References Cited

U.S. PATENT DOCUMENTS

| | | | | |
|---|---|---|---|---|
| 4,223,073 | A * | 9/1980 | Caldwell et al. | 428/422 |
| 5,695,867 | A | 12/1997 | Saitoh et al. | |
| 5,842,686 | A | 12/1998 | Hansen et al. | |
| 6,202,462 | B1 | 3/2001 | Hansen et al. | |
| 6,742,481 | B2 * | 6/2004 | Baldwin | 123/41.35 |
| 7,040,691 | B1 * | 5/2006 | Jacobs et al. | 296/193.07 |

* cited by examiner

*Primary Examiner*—Stephen K. Cronin
*Assistant Examiner*—Hyder Ali
(74) *Attorney, Agent, or Firm*—Quinn Law Group, PLLC

(57) ABSTRACT

A damped windage tray for an engine including a windage tray formed from a laminate. The laminate operates to damp vibrations of the windage tray. The laminate includes a first constraining layer, a second constraining layer and a viscoelastic damping layer disposed between the first and second constraining layer. The viscoelastic damping layer spans substantially the entirety of the first and second constraining layers. Additionally, a method of forming the windage tray is provided.

18 Claims, 2 Drawing Sheets

DAMPED WINDAGE TRAY AND METHOD OF MAKING SAME

TECHNICAL FIELD

The present invention relates to engine windage trays and a method of making the windage trays.

BACKGROUND OF THE INVENTION

Internal combustion engines use oil pans disposed beneath the crankcase of an engine to collect and store oil as a source of oil for an oil pump that distributes it under pressure throughout the engine. The crankcase volume is at least partially defined by a cylinder block having a crankshaft rotatably mounted thereto. The crankshaft mechanically engages pistons, reciprocally movable within bores defined by the cylinder block, through a link such as a connecting rod. The rotational motion of the crankshaft coupled with the reciprocal motion of the pistons combine to cause turbulent airflow within the crankcase. This airflow is sometimes referred to as "windage" and may be pronounced at high engine speeds. The windage may also entrain oil thrown or ejected from journal bearings such as main bearings, which support the crankshaft within the cylinder block, and the rod bearings, which support the connecting rod on the crankshaft. Additionally, the windage may entrain oil already in the sump or collection volume of the oil pan. The windage along with the entrained oil in the crankcase volume operates to increase drag or rotational resistance of the rotating crankshaft thereby reducing the efficiency of the engine. This loss in efficiency may lead to reduced engine performance. Additionally, the oil within the crankcase volume may entrain an amount of air causing the oil within the sump to become aerated. The increased volume of the aerated oil may cause additional oil to become entrained by the windage thereby leading to a "runaway" condition under certain engine operating modes.

Engineers have employed oil deflectors, often referred to as "windage trays", to isolate the effects of the crankshaft and other rotating parts on the oil contained within the oil pan. The windage tray is disposed beneath the rotating parts of the engine and operates to create a barrier between these rotating parts and the oil collection volume of the oil pan. Windage trays are typically mounted to main caps supporting the crankshaft, between the oil pan and the cylinder block, or to the oil pan. Prior art windage trays are simply a panel of metal or molded plastic.

More recently, efforts have been made to reduce the noise, vibration, and harshness, or NVH, of vehicles. One of the main sources of NVH is the internal combustion engine. Although the prior art windage tray may serve a valuable function in controlling engine efficiency loss due to windage, the windage tray and oil pan can be a source of radiated noise. The windage tray may radiate noise due to vibrations caused by the high-speed impact of oil thrown from the crankshaft as well as vibrations transmitted to the windage tray through the part of the engine to which the windage tray is mounted. While both solid metal and molded plastic windage trays may be effective at reducing windage losses within the crankcase, they may create a resonance due to interaction with other engine components thereby increasing the overall engine noise.

SUMMARY OF THE INVENTION

A damped windage tray for an engine includes a windage tray formed from a laminate. The laminate is operable to damp vibrations of the windage tray and includes a first constraining layer, a second constraining layer, and a viscoelastic damping layer disposed between the first and second constraining layers and spanning substantially the entirety of the first and second constraining layers.

The viscoelastic damping layer may include a first viscoelastic layer and a second viscoelastic layer bonded by a high tack polymer layer. Additionally, at least one of the first and second constraining layers may be formed from cold rolled steel or other suitable material. The windage tray may be configured to be mountable to a main cap, an oil pan, or between the oil pan and a cylinder block of the engine. Additionally, the composite loss factor for the laminate may be chosen to have a maximum at approximately the equilibrium oil temperature of the engine. Additionally, an internal combustion engine is disclosed incorporating the damped windage tray of the present invention.

A method of forming a windage tray for an internal combustion engine includes forming a laminate having a first constraining layer, a second constraining layer and a viscoelastic damping layer disposed between the first and second constraining layer and spanning substantially the entirety of the first and second constraining layers. Subsequently, a windage tray is formed from the laminate.

Forming the laminate may include coating the first constraining layer with a first viscoelastic layer and coating the second constraining layer with a second viscoelastic layer. Subsequently the first and second viscoelastic layer are bonded with a high tack polymer. The windage tray may be formed using at least one stamping operation. Additionally, the first constraining layer, the second constraining layer, and the viscoelastic damping layer may be selected such that the maximum composite loss factor of the laminate formed therefrom is substantially coincident with an equilibrium oil temperature of the internal combustion engine.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
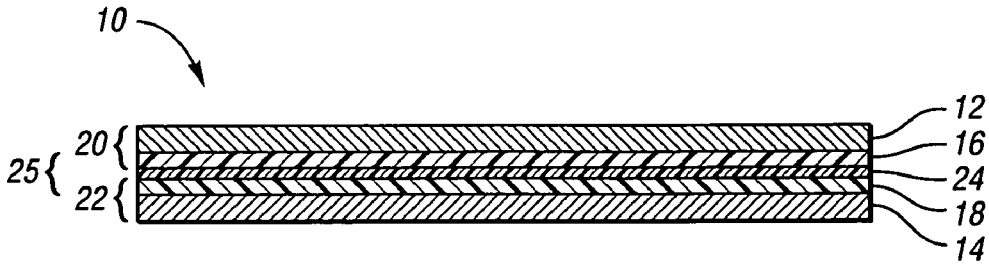
FIG. 1 is a schematic, cross sectional view of a laminated panel structure.

Referring to the drawings wherein like reference numbers refer to like or similar components throughout the several figures, there is shown in FIG. 1 a front cross-sectional view of a laminate 10. The laminate 10 is a laminated sheet structure, which includes a first constraining layer 12 and a second constraining layer 14. A first and second viscoelastic layer 16 and 18, respectively, are disposed between and each spans, or is coextensive with, the entirety of the first constraining layer 12 and the second constraining layer 14. In the preferred embodiment, the first viscoelastic layer 16 is applied to the first constraining layer 12 to form a laminate 20, while the second viscoelastic layer 18 is applied to the second constraining layer 14 to form a laminate 22. The laminates 20 and 22 are bonded by a high tack polymer layer 24 to form the laminate 10. The high tack polymer layer 24 and first and second viscoelastic layer 16 and 18 taken together form a viscoelastic damping layer 25. In the preferred embodiment, the first and second constraining layers 12 and 14 are formed from draw quality cold rolled steel, while the first and second viscoelastic layers 16 and 18 are formed from a high strength damping polymer. Such a laminate 10 is available from Material Sciences Corporation of Elk Grove Village, Ill. USA. Those skilled in the art will recognize that the viscoelastic damping layer 25 may include additional polymer layers in addition to the first and second viscoelastic layer 16 and 18 and the high tack polymer layer 24. The thickness and composition of the viscoelastic damping layer 25 may be modified to tailor the composite loss factor, bond strength, overall stiffness of the laminate 10, as well as additional properties dictated by the specific application.

Figure 2:
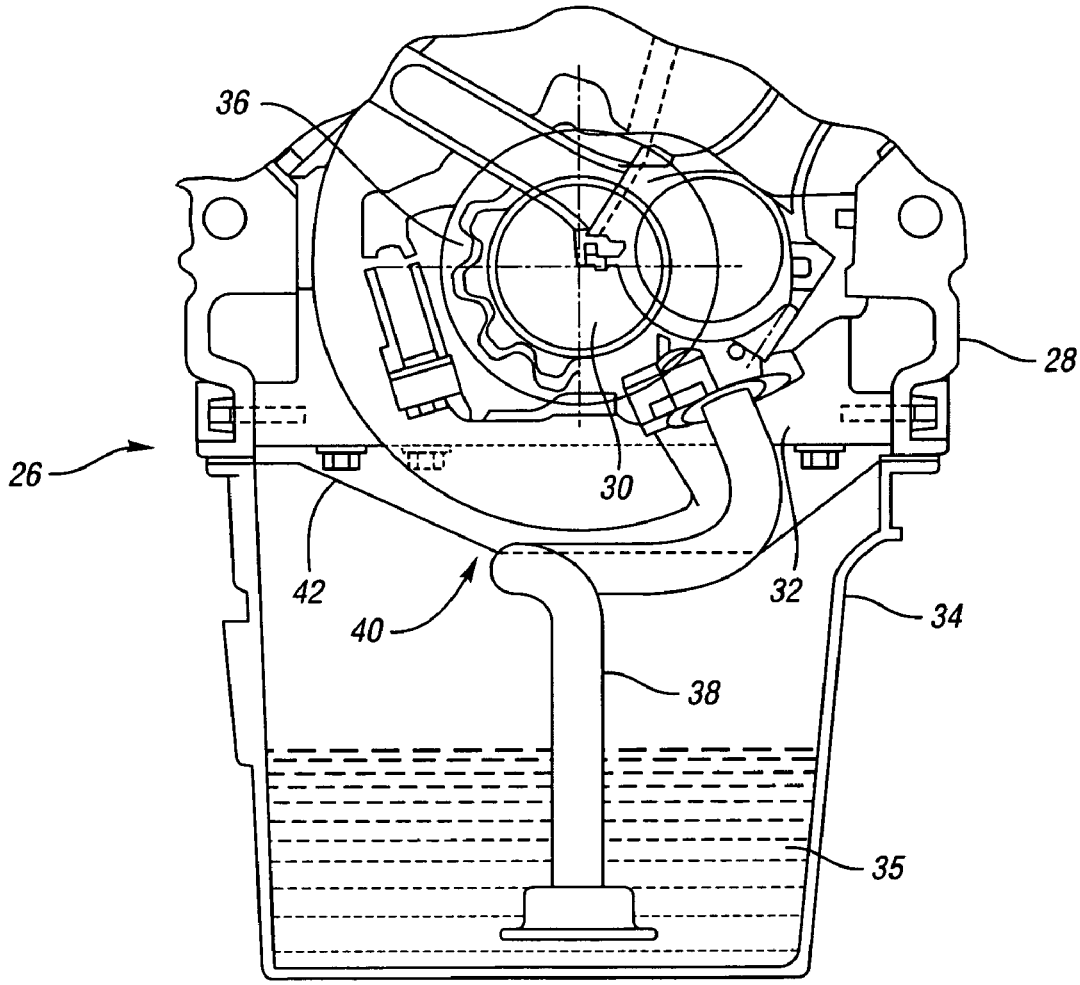
FIG. 2 is a partial view of the lower portion of an internal combustion engine including the damped windage tray of the present invention.

Referring now to FIG. 2, there is shown a portion of an internal combustion engine 26. The engine 26 includes a cylinder case or block 28 having a crankshaft 30 rotatably mounted thereto. The crankshaft 30 is supported within the cylinder block 28 by a plurality of main caps 32, one of which is shown in FIG. 2. An oil pan 34 is mounted to the lower portion of the cylinder block 28 and functions as a reservoir to supply oil 35 to a positive displacement pump 36 through a pickup tube 38. The oil pan 34 and cylinder block 28 cooperate to form a crankcase volume 40. The performance of the engine can be influenced by windage within the crankcase volume 40, therefore an oil deflector or windage tray 42 is provided between the crankshaft 30 and the oil 35 within the oil pan 34. By isolating the windage effects caused by moving parts within the crankcase 40, such as the crankshaft 30, engine performance and efficiency may increase. Additionally the amount of entrained air within the oil 35 delivered to the pump 36 may be reduced by the inclusion of the windage tray 42.

Figure 3:
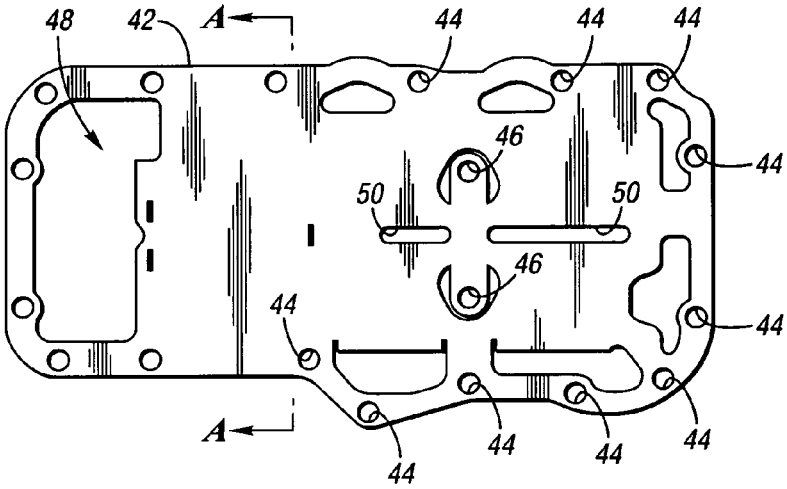
FIG. 3 is a schematic bottom view of the damped windage tray formed from the laminated panel structure of FIG. 1.
Figure 3A:
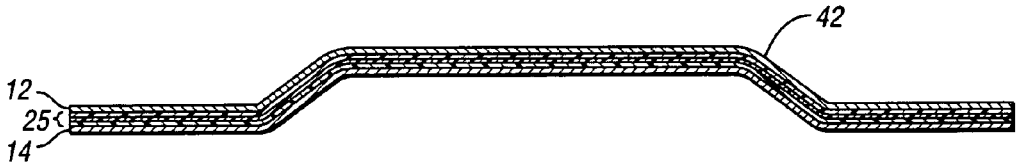
FIG. 3*a* is a sectional view of the windage tray of FIG. 3 taken along line A-A and illustrating the laminated nature of the present invention.

Referring to FIG. 3, and with further reference to FIG. 2, there is shown an exemplary windage tray 42 consistent with the present invention. The windage tray 42 is formed from the laminate 10 described with reference to FIG. 1. The windage tray 42 defines a plurality of holes 44 sufficiently configured to enable mounting of the windage tray 42 between the oil pan 34 and the cylinder block 28. Additionally, a plurality of holes 46 are defined by the windage tray 42 and are sufficiently configured to enable mounting of the windage tray 42 to the main caps 32. An opening 48 is defined by the windage tray 42 to enable the pickup tube 38 to pass therethrough as well as to allow oil drainage to the oil pan 34. Additionally, slots 50 are defined by the windage tray 42 to enable increased control of the oil thrown from the rotating crankshaft 30 during engine operation. Other methods of oil control may include holes, fins, tabs, screens, and grooves. Those skilled in the art will recognize that other methods of mounting the windage tray 42 within the crankcase volume 40 of the engine 26 such as, for example, within the oil pan. However, the windage tray 42 should be mounted above the upper level of the oil 35 shown within the oil pan 34 and sufficiently remote from the crankshaft 30 to avoid interference with moving parts. Referring to FIG. 3A, a side cross-sectional view of the windage tray 42, taken along line A-A of FIG. 3, is shown further illustrating the laminated nature of the present invention. In the preferred embodiment the windage tray 42 is formed by stamping the laminate 10 to the net shape of the windage tray 42 in one or more stamping operations. Preferably, the viscoelastic damping layer 25 will span substantially the entirety of the first and second constraining layers 12 and 14.

Figure 4:
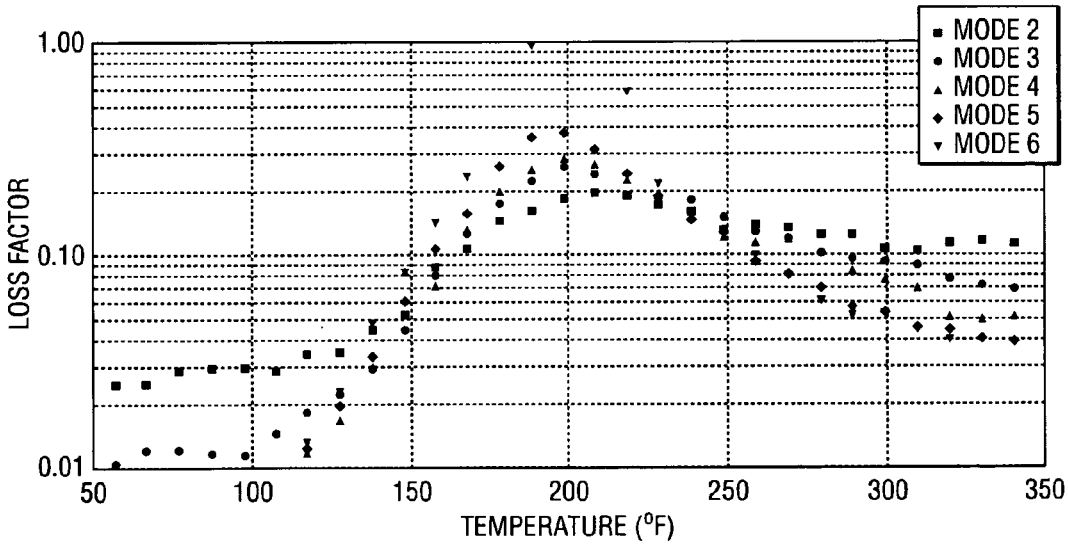
FIG. 4 is a graph depicting the relationship between composite loss factor and temperature for an exemplary construction of the laminated panel structure of FIG. 1.

Referring to FIG. 4, with further reference to FIG. 1, the relationship between the composite loss factor and temperature for an exemplary laminate 10 is shown. The exemplary laminate 10 includes a first and second constraining layer 12 and 14 formed from draw quality cold rolled steel. Each of the first and second constraining layers 12 and 14 are 0.019 inches in thickness. Additionally, the first and second viscoelastic layers 16 and 18 are formed from a high strength damping polymer. Each of the viscoelastic layers 16 and 18 are 0.0006 inches in thickness. While the high tack polymer layer 24 is 0.0004 inches in thickness. The graph shown in FIG. 4 was developed through testing of the exemplary laminate 10 described hereinabove. For testing, a specimen beam of laminate 10 was formed having the spatial dimensions of 8.5 inches in length and 0.75 inches in width. This beam was then mechanically fastened to a high mass fixture such that the beam would function as a free beam of 7 inches in length and 0.75 inches in width having one end fixed. The beam was excited using a magnetic transducer, while an accelerometer recorded the response. Measurements were taken at 10 degrees F. intervals over a range of 50 degrees F. to 350 degrees F. for various modes (2, 3, 4, 5, and 6) of bending. Those skilled in the art should recognize that the dimensions described herein above are only exemplary in nature and are not meant to limit the scope of the present invention. It should also be apparent that the dimensions and composition of the laminate 10 are application specific.

Curves shown in FIG. 4 represent the results of the testing described hereinabove. Each of the curves was generated to represent a different one of the bending modes of the beam. As indicated in FIG. 4, the maximum composite loss factor for the beam is achieved at approximately 200 degrees F. for all modes of bending. This temperature corresponds to the typical equilibrium operating temperature for oil 35 within the internal combustion engine 26. That is, maximum damping and noise attenuation of the windage tray 42 will occur at an oil temperature range within which the typical internal combustion engine 26 most frequently operates. Since the laminate 10, shown in FIG. 1, is coextensive with the entire windage tray 42, a measure of noise attenuation is provided at every point on the windage tray 42. Additionally, the composite loss factor remains relatively high for temperature values above 200 degrees F. should a high oil temperature excursion occur due to factors such as a high ambient air temperature or a performance oriented driving schedule.

Those skilled in the art will recognize that the equilibrium oil temperature is application specific; therefore, the materials and dimensional properties of the laminate 10, shown in FIG. 1, should be tuned to each application. Additionally, it may be desirable to have different compositions for each of the first and second constraining layers 12 and 14. For example, if aesthetics are a concern, one or both of the first and second constraining layers 12 and 14 may be formed from stainless steel or aluminum. Additionally, the respective thickness of the first and second constraining layers 12 and 14 may be different. It is also contemplated that the first and second constraining layers 12 and 14 may be a non-metallic composition such as a composite material possessing the requite properties to provide a desired stiffness to the viscoelastic damping layer 25.

While the best modes for carrying out the invention have been described in detail, those familiar with the art to which this invention relates will recognize various alternative designs and embodiments for practicing the invention within the scope of the appended claims.

The invention claimed is:

1. A damped windage tray for an engine having an equilibrium operating oil temperature, the damped windage tray comprising:

a windage tray formed from a laminate, said laminate being operable to damp vibrations of said windage tray; and wherein said laminate includes a first constraining layer, a second constraining layer and a viscoelastic damping layer disposed between said first and second constraining layers and spanning substantially the entirety of said first and second constraining layers, wherein said viscoelastic damping layer includes a first viscoelastic layer and a second viscoelastic layer bonded to one another by a high tack polymer layer.

2. The damped windage tray of claim 1, wherein at least one of said first and second constraining layers is formed from at least one of a polymeric material and metallic material.

3. The damped windage tray of claim 1, wherein said laminate is tuned to maximize damping when an engine operating temperature reaches approximately 200 degrees F.

4. The damped windage tray of claim 1, wherein the engine includes at least one main cap, and wherein said windage tray is configured to be mountable to the at least one main cap of the engine.

5. The damped windage tray of claim 1, wherein the engine includes an oil pan and a cylinder block, and wherein said windage tray is configured to be mountable between the oil pan and cylinder block of the engine.

6. The damped windage tray of claim 1, wherein the engine includes an oil pan, and wherein said windage tray is configured to be mountable to the oil pan of the engine.

7. The damped windage tray of claim 1, wherein said windage tray defines at least one oil control slot.

8. The damped windage tray of claim 1, wherein said laminate has a maximum composite loss factor at approximately the equilibrium oil temperature of the engine.

9. An internal combustion engine having an oil pan and a crankshaft rotatably supported within a cylinder block by at least one main cap, the internal combustion engine comprising:

a windage tray formed from a laminate, said windage tray being sufficiently configured to be mountable to the internal combustion engine;

wherein said laminate is operable to damp vibrations of said windage tray; and wherein said laminate includes a first constraining layer, a second constraining layer and a viscoelastic damping layer disposed between said first and second constraining layers and spanning substantially the entirety of said first and second constraining layers, wherein said viscoelastic damping layer includes a first viscoelastic layer and a second viscoelastic layer bonded to one another by a high tack polymer layer.

10. The internal combustion engine of claim 9, wherein said windage tray is configured to be mountable to one of the at least one main cap and the oil pan of the engine.

11. The internal combustion engine of claim 9, wherein said windage tray is configured to be mountable between the oil pan and the cylinder block of the engine.

12. The internal combustion engine of claim 9, wherein at least one of said first and second constraining layers is formed from cold rolled steel.

13. The internal combustion engine of claim 9, wherein said laminate is tuned to maximize damping when an engine operating temperature reaches approximately 200 degrees F.

14. The internal combustion engine of claim 9, wherein said laminate has a maximum composite loss factor at approximately the equilibrium oil temperature of the internal combustion engine.

15. A method of forming a windage tray for an internal combustion engine, the method comprising:

forming a laminate having a first constraining layer, a second constraining layer and a viscoelastic damping layer disposed between said first and second constraining layer and spanning substantially the entirety of said first and second constraining layers, wherein said viscoelastic damping layer is formed from a first viscoelastic layer and a second viscoelastic layer; and forming the windage tray from said laminate.

16. The method of claim 15, wherein forming said laminate comprises:

coating said first constraining layer with said first viscoelastic layer;

coating said second constraining layer with said second viscoelastic layer; and bonding said first and second viscoelastic layer with a high tack polymer.

17. The method of claim 15, wherein forming the windage tray includes at least one stamping operation.

18. The method of claim 15, further comprising:

selecting said first constraining layer, said second constraining layer, and said viscoelastic damping layer such that the maximum composite loss factor of said laminate formed therefrom is substantially coincident with an equilibrium oil temperature of the internal combustion engine.

* * * * *